United States Patent [19]

Belokin et al.

[11] Patent Number: 4,901,458

[45] Date of Patent: Feb. 20, 1990

[54] SIMULATED WINGED INSECT OR THE LIKE FOR ADVERTISING DISPLAY

[75] Inventors: Martin P. Belokin; Norman P. Belokin, both of Denton, Tex.

[73] Assignee: Martin Paul, Inc., Denton, Tex.

[21] Appl. No.: 241,357

[22] Filed: Sep. 7, 1988

[51] Int. Cl.[4] ..... A63H 13/20

[52] U.S. Cl. ..... 40/414; 40/417

[58] Field of Search ..... 40/411, 414, 417, 421, 40/423, 429, 614; 272/8 P; 446/236, 247

[56] References Cited

U.S. PATENT DOCUMENTS

| | | | |
|---|---|---|---|
| 1,727,700 | 9/1929 | Dickson | 446/247 |
| 2,922,253 | 1/1960 | Carter | 40/415 |
| 3,477,157 | 11/1969 | Paquette | 40/614 |
| 3,888,030 | 6/1975 | Bradt | 40/614 |
| 3,975,845 | 8/1976 | Mellard | 40/414 |
| 4,180,932 | 1/1980 | Millard | 40/614 |

*Primary Examiner*—Richard J. Apley
*Assistant Examiner*—D. Crosby
*Attorney, Agent, or Firm*—James E. Nilles

[57] ABSTRACT

An advertising display including a simulated winged butterfly, bee or the like, and which is rotatably driven by a battery operated electromotor to simulate the flight of a butterfly and draw the customer's attention to the merchandise displayed therewith. The rotatable display includes a thin piano wire on which the butterfly is mounted at the upper end of the wire, the lower end of the wire being secured to a rotatably driven member in such a manner as to preclude breakage due to the repeated flexing. An upper end portion of the wire is bent so that the butterfly trails in the direction of rotation of the driven member and produces a particularly lifelike, articulated and swinging movement of the butterfly.

10 Claims, 2 Drawing Sheets

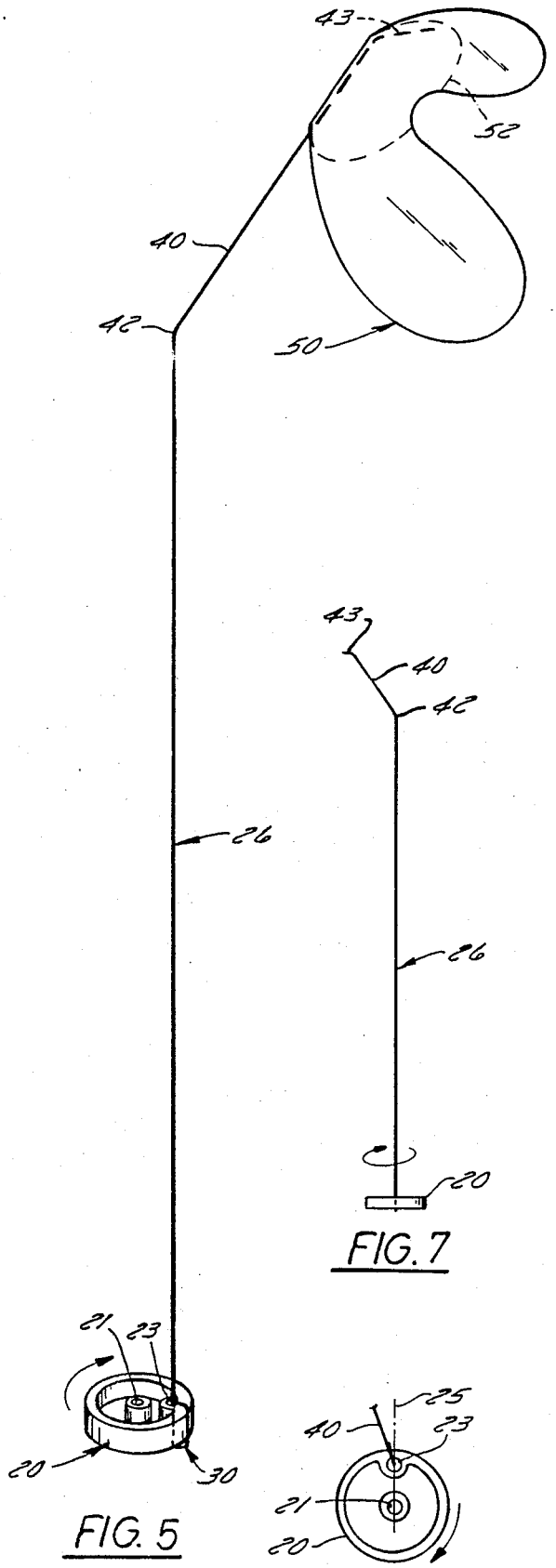
FIG. 5
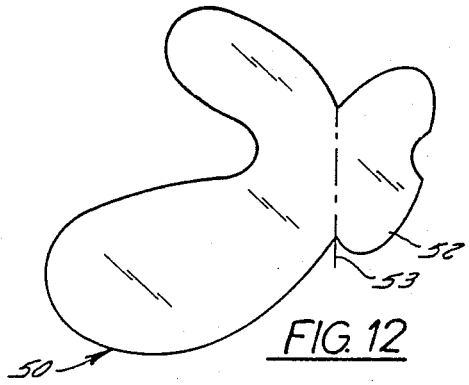
FIG. 12
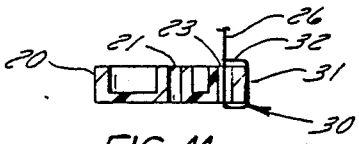
FIG. 11
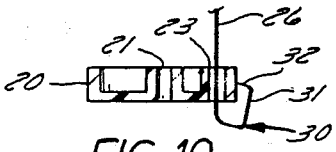
FIG. 10
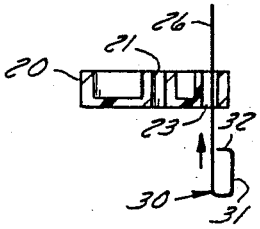
FIG. 9
FIG. 7
FIG. 6
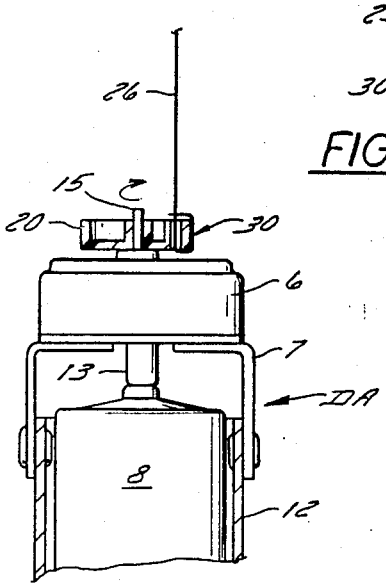
FIG. 8

SIMULATED WINGED INSECT OR THE LIKE FOR ADVERTISING DISPLAY

BACKGROUND OF THE INVENTION

1. Field of the Invention

This invention relates to a rotatable display with special effects and being electromotor operated, such as an animated winged flying butterfly, bee or the like, and which form part of an advertising display.

2. Background Information

U.S. Pat. No. 4,180,932, issued Jan. 1, 1980, entitled "Animated Plant Display", discloses butterflies mounted on a wire which is secured to a housing. A platform adjacent the wires rotates while the wires themselves are stationary and do not rotate. As the platform rotates it successively strikes the wires to cause vibrations in the wire, and in the simulated butterfly. It does not rely on centrifugal force and rotative wire movement to direct the butterfly in an annular path, but rather the butterfly movement is constrained to a straight line.

U.S. Pat. No. 3,477,157, issued Nov. 19, 1969, entitled "Advertising Display", shows a device simulating a firefly mounted on a flexible support which in turn is anchored in an angularly oriented flippable holding member. The member is attached to a rotatable shaft having a loose connection and imparts a jerking motion on the member. However, the angular movement in this device is not as a result of centrifugal force, but is an irregular movement caused by the loose connection and the type of flippable holding member to which a steel spring is attached.

SUMMARY OF THE INVENTION

The present invention provides a display simulating a flying insect such as a butterfly, or the like, which is mounted on a thin, tempered piano wire of small diameter, the wire having means at its lower end for being attached to a driven member. The driver member to which the wire is attached has a central hole for receiving a driving shaft, and the wire is fastened adjacent the edge of the driven member and in a relatively loose manner to prevent repeated bending of the wire at its attachment point and consequent fatigue failure. The wire is bent at its upper portion and a simulated insect such as a butterfly, bee or the like, is secured to the uppermost end of the wire. When the simulated insect display is drivingly rotated, the insect assumes a flying motion in a wide swinging and vigorously undulating action. A more specific aspect of the invention relates to the fastening of the wire by means of a loop at its lower end to the peripheral portion of the driven member. When the driven member rotates the upper bent portion of the wire assumes a trailing position with respect to a radius line extending through the center hole and the peripheral edge hole of the driven member. In a more specific aspect of invention relates to the simulated insect being formed of a flexible member which has an adhesive portion that can be folded over the remainder of the flexible member to securely fasten it to a bent endmost portion of the wire.

Another aspect of the invention relates to a point of purchase advertising display assembly, including a battery driven motor and its upwardly extending driven shaft. The battery driven motor assembly is mounted in the upper end of a display stand, and a display of flowers located adjacent the upper end of the display stand to form an attractive environment for the above described display which simulates a winged flying insect having a particularly life-like motion.

These and other objects and advantages of the present invention will appear as this disclose progresses.

BRIEF DESCRIPTION OF THE DRAWINGS

FIG. 5 is a perspective, enlarged view of the butterfly simulating display which is also shown at the top of the stand in FIG. 1;

FIG. 6 is a plan view of the butterfly simulating display shown in FIG. 5 and showing the trailing position of the bent wire as it rotates;

FIG. 7 is a side elevational view of the display as shown in FIG. 6;

FIG. 8 is a fragmentary, enlarged view of driving unit with the butterfly display attached at the upper end thereof for being driven thereby;

FIGS. 9, 10 and 11 are cross-sectional views showing the steps in assembling the piano wire on the rotatably driven member of the display; and FIG. 12 is a view of the simulated butterfly before it is folded over on the piano wire of the display.

DESCRIPTION OF THE PREFERRED EMBODIMENT

Figure 1:
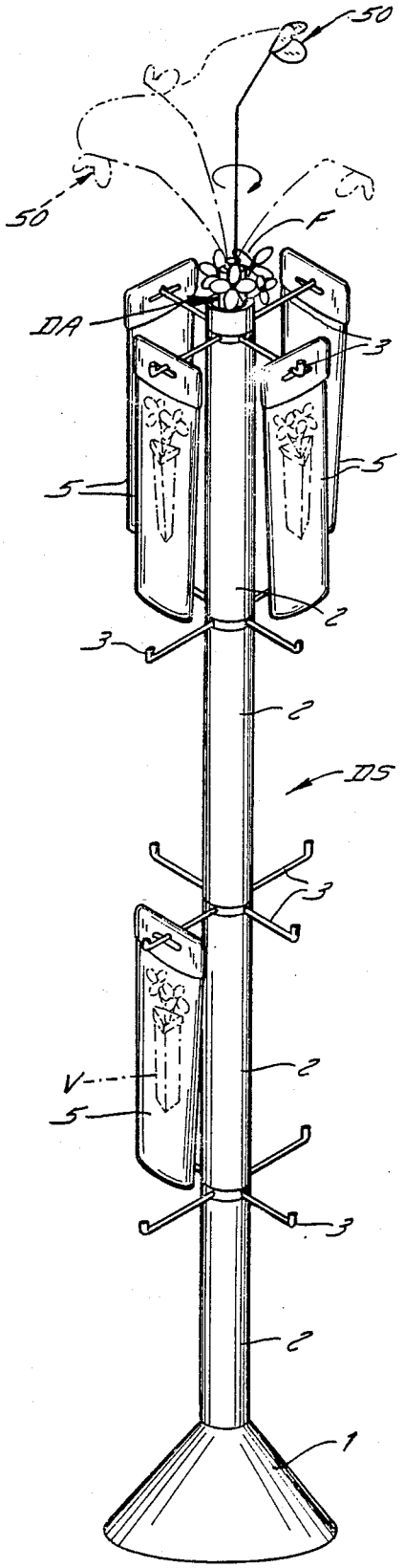
FIG. 1 is a perspective view of a display stand having a display simulating a butterfly supported at the top thereof.
Figure 4:
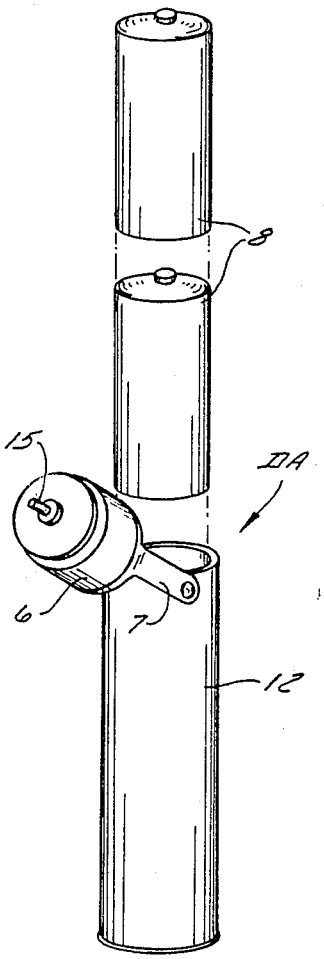
FIG. 4 is an exploded perspective view of the driving assembly shown in FIG. 3.
Figure 3:
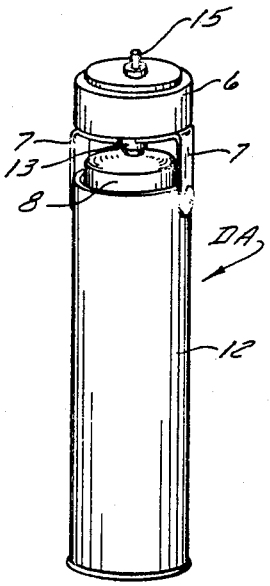
FIG. 3 is a perspective view of the battery driven motor assembly for the display and located at the top of the display stand shown in FIG. 1.
Figure 2:
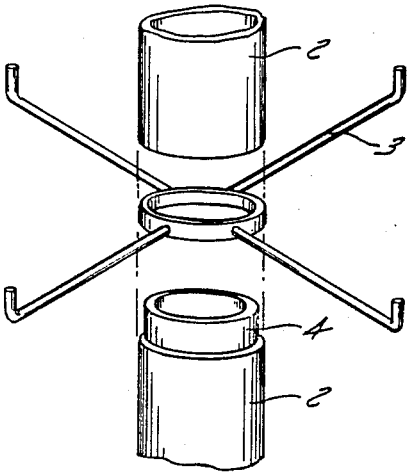
FIG. 2 is a fragmentary exploded view of a portion of the display stand shown in FIG. 1, but on an enlarged scale.

The display shown in FIG. 1 is adapted to be used among real or artificial flowers which are displayed in garden shops, floral shops, and in grocery stores or the like.

The display stand DS comprises a styrofoam base 1 on which is supported the telescoping, cardboard tubular members 2 and which have a plastic hook assembly 3 secured around a reduced diametrical portion 4 of the lower tubular member 2 of adjacent pairs of members 2. The plastic assembly 3 has outwardly extending hooks on which the merchandise to be displayed is hung.

In the environment shown, the merchandise consists of a flower vase V secured in the package 5, the vase in this case being provided for flowers, for example.

To attract the customers attention to the flower vase package, a group of flowers F are mounted at the top of the display stand.

The simulated butterfly display as shown in FIG. 5 is attached to the driving assembly DA (FIG. 8) which is inserted in and held in fixed position at the top of the stand DS, as shown in FIG. 1. The driving assembly includes the conventional battery driven motor 6, which is pivotly attached by the bracket 7 to the cylindrical battery holder 12.

Conventional batteries 8 are located in the battery holder and a spring (not shown) is located in the bottom of the holder 12 to urge the batteries upwardly so that the uppermost battery contacts the downwardly extending contact 13 of the motor 6. A driven shaft 15 extends upwardly from the motor and is driven thereby in the known manner. The shaft 15 can be rotated in either direction, depending on the way the two batteries are inserted, i.e., with the positive side up or down.

A driven member 20 (FIGS. 5–11) of the simulated butterfly display has a central hole 21 so that it can be pressed into engagement with the driven shaft 15. The driven member 20 has a hole 23 located adjacent its periphery and on a radius line 25 with respect to the rotatable center of the driven member. This simulated butterfly display includes a thin, tempered piano wire 26 which is of such a diameter that preferably can be seen only by close examination. This piano wire is very hard and preferably of 0.015 inch gauge.

The piano wire 26 is mounted on the rotatable member 20 so that it is not continually bent or flexed at its point of juncture with the member 20. This is accomplished as shown in the FIGS. 9, 10 and 11. The lower end of the wire is formed as a loop 30 having an upwardly extending leg 31 and an inwardly turned portion 32. The loop 30 embraces the peripheral edge of the member 20 but is not tightly engaged therewith, so that continual flexing of the wire, due to the action of the butterfly, will not repeatedly bend or stress the wire to cause its breakage.

To assemble the wire on the driven member, the upper end of the wire is inserted (FIG. 9) upwardly through the peripheral hole 23. As shown in FIG. 10 the loop is then opened so as to permit the upper portion 32 of the loop to pass over the peripheral portion of the driven member 20. When the wire is fully inserted in the driven member, the loop, due to the spring action of the wire, closes, thus holding the wire captive on the driven member, but in a relatively loose manner.

As shown in FIG. 6, when the rotatably driven member is drivingly rotated as shown by the arrow in FIG. 6, the offset upper bent portion 40 of the wire assumes a rearward rake or angle in respect to the radius line 25 which passes through holes 21 and 23 of member 20. The side elevational view shown in FIG. 7, shows the upper trailing bent portion 40 in respect to the main portion of the wire 21.

A bend 42 in the wire is located in the upper portion of the overall length of the piano wire, and this gives the proper flutter, or undulating action of the butterfly when rotating.

The simulated butterfly 50 is cut from particularly thin, but strong material and somewhat stiff with slight flexibility, material such as plastic or paper and is colorful in nature so as to attract attention, preferably being of luminous material.

The butterfly has an adhesive portion 52 (FIG. 12) which is folded on the line 53 and around the upper end of the wire so as to firmly engage and be attached to the wire. It will be noted that the uppermost end 43 of the wire (FIGS. 5 and 7) is bent so that when it is pressed between the folded portions of the butterfly, the butterfly will not turn bodily on the wire. The butterfly, after it has been attached to the wire does not actually represent a full or complete butterfly facsimile. A special visual effect is created by the irrational movement of the wire which gives an optical illusion that the butterfly is whole. Thus, the printed and assembled butterfly forms a fluttering object, leaving the motion to optically complete the object by illusion.

With the fast rotary motion provided to the butterfly facsimile, by making the facsimile only as one half of a butterfly, better fluttering action is obtained, and less drag is generated than would be with a full butterfly design.

Thus the piano wire 26 is mounted in a hole 23 which is larger than the wire itself, and in a manner to provide a certain amount of freedom, so that the wire will not fail because of fatigue due to repeated bending. In other words if the wire were mounted tightly on the driven member 20, the continual bending back and forth would cause the wire to break.

Also, the wire is anchored on the driven member 20 in one direction so that when it is rotated, proper fluttering and undulating action of the butterfly occurs, as follows. When in operation, the upper portion 40 of the wire, as shown in FIG. 6, assumes a trailing position with respect to the radius line 25 on which the lower end of the wire is loosely mounted to the driven member 20. The rotatable simulated butterfly provides the appearance of a particularly vigorous and active butterfly which rapidly assumes the various positions shown by the dotted lines in FIG. 1. This gives the appearance of a fluttering and undulating flying movement of the butterfly, rather than simply rotating about the stand or simply moving back and forth. In other words there is a certain amount of up and down movement as well as radially inward and outward movement of the butterfly as the batteries drive the simulated display. The entire arrangement immediately catches the eye of the customer and draws his attention to the merchandise associated therewith.

We claim:

1. A display simulating a flying insect such as a butterfly, bee or the like, and comprising;

a rotatably driven member having a central, generally vertically disposed hole for being drivingly engaged on a driving shaft, a thin, tempered piano wire of a small diameter having means for being attached to said driven member adjacent the periphery of the latter, said wire extending upwardly from said driven member and being bent to form a bent portion at an upper portion of said wire, and a simulated insect such as a butterfly or the like secured to the upper end of said wire, whereby when said simulated insect display is drivingly rotated, said insect assumes a flying motion in a wide swinging and vigorously undulating action.

2. The display set forth in claim 1 further characterized in that said driven member has a second hole located adjacent the periphery of said driven member, and said wire has a loop at its lower end, said wire extending upwardly through said second hole and having its loop portion engaging and embracing a peripheral portion of said driven member, whereby when said driven member rotates said bent portion of said wire assumes a trailing position with respect to a radius line extending through said holes and in respect to the direction of rotation.

3. A display as set forth in claim 1 wherein said wire is of a diameter of approximately 0.015 inch gauge.

4. The display as set forth in claim 1 further characterized in that the uppermost end of the wire is bent to form a bent end, and said simulated insect is a flexible member formed as a butterfly and having an adhesive portion, said adhesive portion being folded over the remainder of said flexible butterfly and over said bent end of said wire so as to securely fasten said butterfly to said wire to prevent relative movement therebetween.

5. The display set forth in claim 1 including means for rotating the driven member at a speed of about 200–300 rpm and the simulated insect bounces about and follows in the irregular annular path which approximates the flight of a butterfly.

6. A point of purchase advertising display assembly including, a vertically arranged support having a plurality of merchandise supporting members extending therefrom and having an upper end, a battery driven motor assembly including a motor having an upwardly extending driven shaft, said motor assembly being mounted in the upper end of said display stand, a display of flowers located at the upper end of said display stand, and a display simulating a winged flying insect such as a butterfly, bee or the like and comprising, a rotatably driven member having a central, generally vertically disposed hole for being drivingly engaged on said shaft, a thin, tempered piano wire of a small diameter to render it difficult to see, said wire having means for being attached to said driven member adjacent the periphery of the latter, said wire extending upwardly from said driven member and being bent to form a bent portion at an upper portion of said wire, and a simulated insect such as a butterfly or the like secured to the upper end of said wire, whereby when said simulated insect display is drivingly rotated, said insect assumes a flying motion in a wide swinging and vigorously undulating action.

7. The display assembly set forth in claim 6 further characterized in that said driven member has a second hole located adjacent the periphery of said driven member, and said wire has a loop at its lower end, said wire extending upwardly through said second hole and having its loop portion loosely engaging and embracing a peripheral portion of said driven member, whereby when said driven member rotates said bent portion of said wire assumes a trailing position with respect to a radius line extending through said holes and in respect to the direction of rotation.

8. A display assembly as set forth in claim 6 wherein said wire is hardened and of a diameter of approximately 0.015 inch gauge.

9. The display assembly as set forth in claim 6 further characterized in that the uppermost end of the wire is bent to form a bent end and said simulated insect is a flexible member having an adhesive portion, said adhesive portion being folded over the remainder of said flexible member and over said bent end of said wire so as to securely fasten said flexible member to said wire 10. The display set forth in claim 6 wherein the driven member is rotated at a speed of about 200–300 rpm and the simulated insect bounces about and follows in the irregular annular path which approximates the flight of an insect.

* * * * *